US006084975A

United States Patent [19]

Perkins

[11] Patent Number: 6,084,975

[45] Date of Patent: Jul. 4, 2000

[54] PROMONTORY TRANSMITTING COIL AND TYMPANIC MEMBRANE MAGNET FOR HEARING DEVICES

[75] Inventor: Rodney C. Perkins, Woodside, Calif.

[73] Assignee: ReSound Corporation, Redwood City, Calif.

[21] Appl. No.: 09/080,956

[22] Filed: May 19, 1998

[51] Int. Cl.[7] ..... H04R 25/00

[52] U.S. Cl. ..... 381/326; 381/312; 381/328; 181/324; 600/25

[58] Field of Search ..... 381/312, 328, 381/326, 324, FOR 130; 181/129, 130, 134; 600/25; 607/55, 56, 57

[56] References Cited

U.S. PATENT DOCUMENTS

| | | | |
|---|---|---|---|
| 4,606,329 | 8/1986 | Hough | 381/326 |
| 4,936,305 | 6/1990 | Ashtiani et al. | 600/25 |
| 5,015,225 | 5/1991 | Hough et al. | 600/25 |
| 5,259,032 | 11/1993 | Perkins et al. | 381/313 |
| 5,456,654 | 10/1995 | Ball | 381/326 |
| 6,005,955 | 12/1999 | Kroll et al. | 381/328 |

*Primary Examiner*—Curtis A. Kuntz
*Assistant Examiner*—Suhan Ni
*Attorney, Agent, or Firm*—Burns, Doane, Swecker & Mathis, L.L.P.

[57] ABSTRACT

In a hearing system, a transmitting coil is positioned on the promontory centered medial to the umbo of the tympanic membrane while securing the magnet to a surface of said tympanic membrane or to the manubrium of the malleus. The system does not require the permanent placement of components in the auditory canal which would otherwise interfere with normal hearing when the system is not in use.

26 Claims, 3 Drawing Sheets

PROMONTORY TRANSMITTING COIL AND TYMPANIC MEMBRANE MAGNET FOR HEARING DEVICES

FIELD OF THE INVENTION

The present invention provides hearing systems that enable or enhance an individual's ability to hear by imparting mechanical vibrations to the tympanic membrane or by converting mechanical vibrations from the tympanic membrane into signals that contain audio information.

BACKGROUND OF THE INVENTION

Surgically implantable hearing systems that deliver audio information to the ear through electromagnetic transducers are well known. These transducers convert electromagnetic fields, modulated to contain audio information, into mechanical vibrations which are imparted to the tympanic membrane or parts of the middle ear. The transducer, typically a magnet, is subjected to displacement by electromagnetic fields to impart vibrational motion to the portion to which it is attached, thus producing sound perception by the wearer of such an electromagnetically driven system. This method of sound perception possesses some advantages over acoustic drive systems in terms of quality, efficiency, and elimination of "feedback," a well-known problem common to acoustic hearing systems.

SUMMARY OF THE INVENTION

The present invention is directed in part on the discovery that positioning a transmitting coil on the promontory centered medial to the umbo of the tympanic membrane while attaching a magnet to a surface of the tympanic membrane or to the manubrium of the malleus provides a superior hearing system. An important advantage, in some circumstances, is that the system does not require the permanent placement of components in the auditory canal which would otherwise interfere with normal hearing when the system is not in use.

In one aspect, the present invention is directed to a hearing system, for imparting audio information to an individual by vibrating the tympanic membrane of the middle ear of the individual, that includes:

signal producing means for producing signals containing audio information which comprises a transmitting coil mounted on the promontory of the middle ear; and a transducer means responsive to said signal to cause mechanical vibrations representing said audio information, wherein said transducer means resides on a surface of said tympanic membrane or is attached to the manubrium of the malleus.

In another aspect, the invention is directed to a hearing system for imparting audio information to an individual that includes:

a first device for converting acoustic energy into first electrical signals, comprising a magnet that resides on a surface of the tympanic membrane that is attached to the manubrium of the malleus of the individual's first ear and a coil mounted on the promontory centered medial to the umbo of the middle ear of said first ear, said coil responsive to movement of the magnet to create a first current in said coil; and a second device for converting said first current into mechanical vibrations that correspond to the audio information wherein said second device is positioned in the first ear or in the individual's second ear.

In yet another aspect, the present invention is directed to a method, for imparting audio information to an individual by vibrating a tympanic membrane of individual, that includes the steps of:

providing a signal producing means for producing signals containing audio information which comprises a transmitting coil mounted on the promontory of the middle ear; and securing a transducer means responsive to said signal to cause mechanical vibrations representing said audio information to a surface of said tympanic membrane or to the manubrium of the malleus.

In a further aspect, the invention is directed to a method for imparting audio information to an individual, that includes the steps of:

providing a first device for converting acoustic energy into first electrical signals, comprising a magnet that is attached to a surface of the tympanic membrane or to the manubrium of the malleus of the individual's first ear and a coil mounted on the promontory centered medial to the umbo of the middle ear of said first ear, said coil responsive to movement of the magnet to create a first current in said coil; and providing a second device for converting said first current into mechanical vibrations which correspond to audio information wherein the second device is positioned in the first ear or in the individual's second ear.

BRIEF DESCRIPTION OF THE DRAWINGS

The present invention can be further understood by reference to the appended drawings wherein like numerals designate the same element throughout the several figures. In the drawings.

DETAILED DESCRIPTION OF THE PREFERRED EMBODIMENTS

There will now be described a hearing system that comprises a signal producing means for producing electromagnetic signals that contain audio information, and a tympanic membrane contact transducer which receives said signals and imparts mechanical vibrations to the ear. Alternatively, the transducer can be attached to the manubrium of the malleus. An important aspect of the system is that the signal producing means comprise one or more coils that are attached on the promontory centered medial to the umbo area. The umbo area, for present purposes, can be understood to be the conical depression at the center of the tympanic membrane where it attaches to the inferior end of the malleus.

Figure 1:
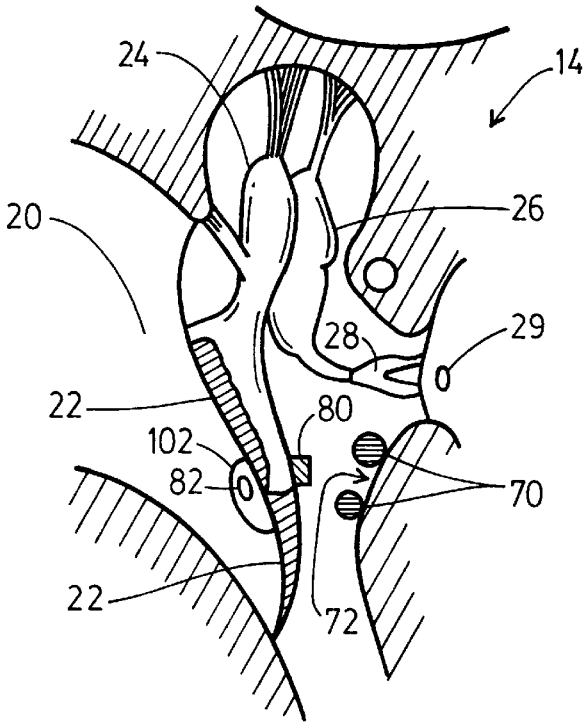
FIG. 1 is a sectional view of the middle ear showing the transmitting and transducing means of the present invention which are adapted to be implanted in the promontory and tympanic membrane, respectively, of the ear.

Referring now to FIG. 1, there is shown a cross sectional view of a middle ear 14 which contains a series of three tiny interconnected bones: the malleus (hammer) 24; the incus (anvil) 26; and the stapes (stirrup) 28. Collectively, these three bones are known as the ossicles or the ossicular chain. The malleus is attached to the tympanic membrane 22 while the stapes, the last bone in the ossicular chain, is attached to the oval window 29.

In unimpaired hearing, sound waves that travel down the outer ear or auditory canal 20, strike the tympanic membrane and cause it to vibrate. The malleus, being connected to the tympanic membrane, is thus also set into motion, along with the incus and the stapes. These three bones in the ossicular chain act as a set of levers to amplify the tiny mechanical vibrations received by the tympanic membrane. The stapes vibrates in turn causing fluid in a spiral structure known as the cochlea (not shown) to move along its length. Very small hairlike cells (not shown) in the cochlea are stimulated by the movement of fluid in the cochlea. There, hydraulic pressure displaces the inner ear fluid and mechanical energy in the hair cells is transformed into electrical impulses which are transmitted to neural pathways and the hearing center of the brain (temporal lobe), resulting in the perception of sound.

Figure 4A:
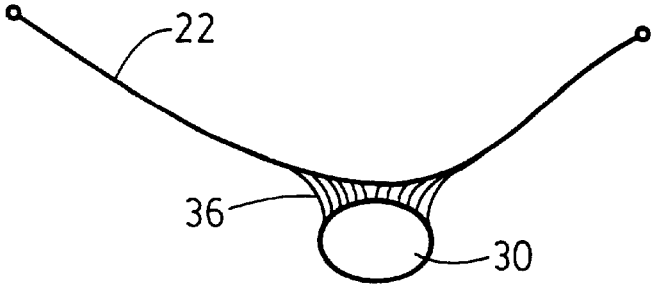
FIGS. 4A, 4B and 4C illustrate the attachment of a transducer to the medial surface of the manubrium of the malleus.
Figure 4B:
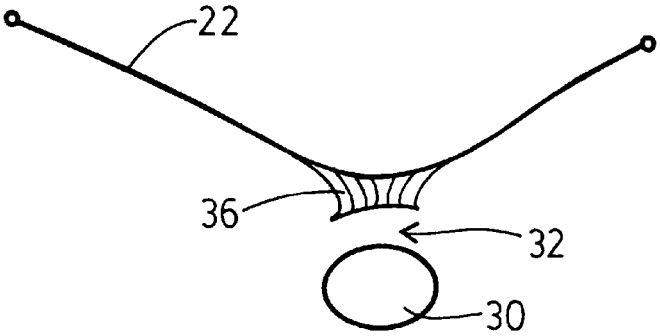
Figure 4C:
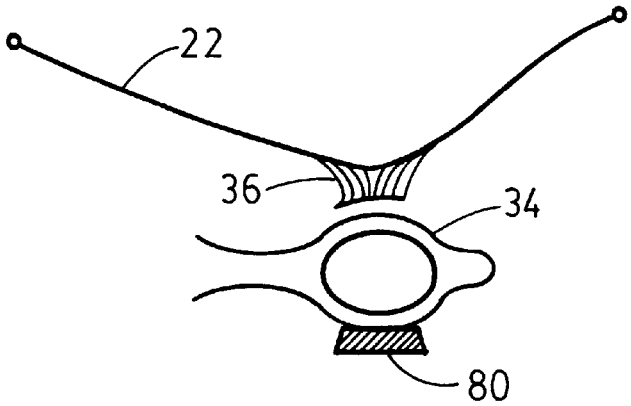

Referring still to FIG. 1, a promontory coil 70, which is an electromagnetic transmitting coil, is placed on the promontory centered medial 72 to the umbo. In this embodiment, transducer means (e.g., magnet) 80 is attached to the medial side of the inferior manubrium. Preferably transducer means 80 is encased in titanium or other biocompatible material. As illustrated in FIGS. 4A–4C, a method of attaching magnet 80 to the medial surface of the manubrium 30 of the malleus is to make an incision in the posterior periosteum 36 of the lower manubrium, elevate the periosteum from the manubrium thus creating a pocket 32 between the lateral surface of the manubrium and the tympanic membrane 22. One prong of a stainless steel clip device 34 with the titanium encased magnet 80 attached thereto is placed into the pocket. The interior of the clip is of appropriate dimension such that the clip now holds onto the manubrium placing the magnet on its medical surface.

FIG. 1 also depicts a second embodiment wherein transducer means (e.g., magnet) 82 resides on the exterior surface of the tympanic membrane. By residing on the surface is meant that the transducer means 82 is placed in contact with an exterior surface of the tympanic transducer. A preferred method of so positioning the transducer is to employ a contact transducer assembly that includes transducer 82 and support means 102. Support means 102 is attached to a portion of the tympanic membrane 22 at the opposite surface of support means 102. Preferably, the surface of support means 102 that is attached to the tympanic membrane substantially conforms to the shape of the corresponding surface of the tympanic membrane, particularly the umbo area. A surface wetting agent, such as mineral oil, is preferably used to enhance the ability of support means 102 to form a weak but sufficient attachment to the tympanic membrane through surface adhesion. A suitable contact transducer assembly is described in U.S. Pat. No. 5,259,032, which is incorporated herein. The magnets in both configurations are expected to exhibit excellent coupling to the electromagnetic field of the transmitting promontory coil.

As used herein, a transducer may comprise a magnet or magnetic particle dispersed throughout a membrane or attached structure, a coil or multiple coils, piezoelectric elements, passive or active electronic components in discrete, integrated, or hybrid form, or any singular component or combination of components that will impart vibrational motion to the tympanic membrane in response to appropriately received signals or any other means suitable for converting modulated electromagnetic waves to mechanical vibrations. The promontory coil generates a modulated electromagnetic field which contains audio information. The audio information can be first captured by microphone, as in a conventional acoustic hearing aid, or may be captured by other means such as an FM receiver or FM antenna.

Figure 3:
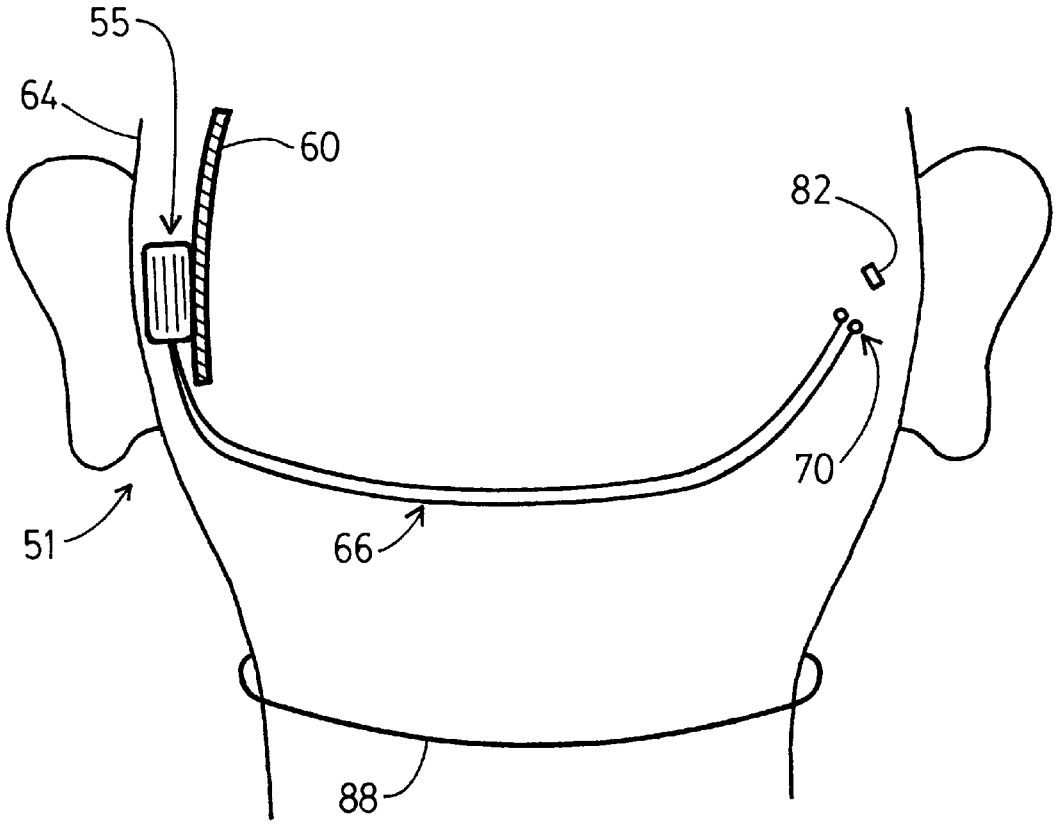
FIG. 3 is a sectional view of the skull showing the hearing system of the invention which is adapted to be implanted.

The transducer that resides on or is attached to the manubrium, can also interact with a magnetic field from an external drive means. The drive means preferably include an air core coil larger than an individual's head and adapted to be supported in relation to the magnet such that the magnet is within the electromagnetic field produced by the coil. The driving means further include a source of current corresponding to audio signals for flow through the coil. The audio signals correspond to actual sound, such as, for example, human speech and music. A preferred remote electromagnetic drive is described in U.S. Pat. No. 5,425,104, which is incorporated herein. A preferred external coil device is available as the SOUNDLINK® system from ReSound Corp., Redwood City, Calif. The external coil can be constructed to be worn by the individual in any convenient fashion such a headgear or necklace 88 as shown in FIG. 3.

A feature of the illustrated promontory coil system is that all implanted components can be passive. Furthermore, should the patient require an MRI scan magnet 82 can be easily removed. Likewise, the manubrial magnet 80 could be designed to be removable through a myringotomy incision.

Figure 2:
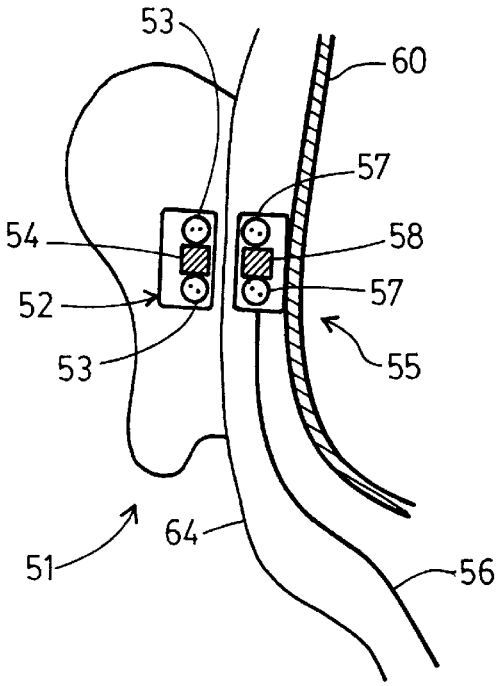
FIG. 2 is a schematic sectional view through the skull of an individual with the hearing device of the present invention.

Shown in FIG. 2 is an embodiment where the electronic components for capturing sound and relaying electrical information to the promontory coil are mounted underneath the skin 64 and on the mastoid bone 60 of the skull. The components comprise a sound processing component 51 for converting sound into an analog electric signal. This sound processing means includes an outer (or external) unit 52 which is adapted to be positioned supercutaneously on the skull of the user, preferably, behind the ear for transmitting the electromagnetic signal transcutaneously.

The sound processing means 51 comprises electronic circuitry including, for example, a sensitive microphone for converting sound waves into electrical signals that are processed and passed to an external transmitter for generating an electromagnetic field having an amplitude proportional to the amplitude of the sound waves received by the microphone. The sound processing unit also includes a battery. The external transmitter comprises an external electromagnetic transduction coil 53 wound about external centering magnet 54.

The sound processing means 51 further includes an internal signal receiving and transmitting unit 55 adapted to be implanted in the mastoid area of temporal bone of the user for receiving the transcutaneous electromagnetic signal from the external transmitter and for transmitting an electric signal subcutaneously to the promontory coil via electric wires 56. Internal component 55 may be attached to the bone with titanium screws. In another embodiment, the internal component may reside in a receptacle created in the mastoid bone. This signal receiving and transmitting component 55 includes an electromagnetic signal receiving means preferably in the form of an internal receiving coil 57 wound about internal magnet 58 for receiving the transcutaneous electromagnetic signal from the sound processing component transmitter 51.

In this embodiment, the external and internal centering magnets are employed to coupled external unit 52 to internal unit 55. The magnets also position the external transmission coil 53 directly over the internal receiving coil 57.

Preferably a microphone is located in external unit 52. Alternatively, it can be positioned on an earhook or it could be connected to the external unit by small wires and reside inconspicuously in a surgically created hole in the lower concha. In another embodiment, the external unit can be incorporated into the ear piece of an eye glass. Such placement would allow for the utilization of array microphones located on the eyeglasses and provide exceptional noise cancellation and directional listening possibilities.

In operation, incoming acoustic signals (e.g. sound) are captured by the microphone, processed and converted to a current in the external transmitter. By electromagnetic transduction a similar current is created in the internal subcutaneous receiving coil 57 which causes current flow in the promontory coil creating an electromagnetic field. Magnet 80 or 82 reacts to the field thereby causing the tympanic membrane and ossicular chain to mechanically vibrate.

As is evident, the electronic components to capture acoustic signals can be designed into a number of configurations suitable for surgically implantable hearing systems. Further, it is understood that electronic components employed for the present hearing system are conventional equipment as used in audio devices and hearing aids in particular. Suitable electronic components are described, for example, in U.S. Pat. Nos. 5,425,104, 5,259,032, 5,220,918, 4,957,478, 4,776,322, 4,741,339 and 4,606,329, which are all incorporated herein.

The configuration of the promontory coil and magnet as shown in FIG. 1 can also be employed to create a signal that can be used to deliver audio information or signals generated by vibrations of the tympanic membrane. Specifically, when sound waves traveling down the outer ear or auditory canal strike the tympanic membrane, vibrations from the membrane will cause the magnet to move. This motion will induce a current in the promontory coil which is representative of the audio signals. This configuration can be employed, for instance, by a person who has one (first) ear that is impaired to the extent that a conventional hearing instrument is essentially useless while the other (second) ear is normal or at least can be rehabilitated. This embodiment of the invention is illustrated by the hearing system shown in FIG. 3 where, for example, the individual's right ear is impaired and has magnet 82, attached to the exterior surface of the tympanic membrane, that is coupled to promontory coil 70.

In operation, induced current from coil 70 in the impaired right ear is employed to vibrate the tympanic membrane in the left ear which has a transducer attached to the medial side of the inferior manubrium or residing on the tympanic membrane as illustrated in FIG. 1. Although the coil in the impaired right ear can be directly electrically connected by a wire to the coil in the left ear, the current so transmitted may be too attenuated. Therefore, as shown in FIG. 3, preferably the current is first transmitted through wire 66 to a signal processing means 51 which converts the induced current from the coil into signals for generating electromagnetic fields which displace transducers located in the left ear. The sound processing means is preferably adapted to be implanted under skin 64 in the mastoid area 60 and includes internal component 55 that is attached to the mastoid bone with titanium screws or that is positioned in a receptacle in the mastoid bone. Signal processing means may include, for example, a battery and amplifier to increase the current level. In operation, sound waves entering the right ear are converted into a current which is transmitted to the signal processing means. Signals therefrom in turn causes the tympanic membrane and ossicular chain to vibrate in the left ear by means of the magnet and promontory coil structures which had been placed in the left ear as illustrated in FIG. 1.

As depicted in FIGS. 2 and 3, the wires 56 and 66 are subcutaneous. The wire can be implanted by first attaching one end to a coil which is collapsed into the lumen of a specially designed periosteal threading instrument. Utilizing a series of small separated skin incisions the coil and wire could be threaded along the periosteum of the back of the skull to the opposite mastoid area.

An advantage of the above-described systems is that they are passive in that they do not impede normal hearing when not in use.

Although only preferred embodiments of the present invention are specifically disclosed and described above, it will be appreciated that many modifications and variations of the present invention are possible in light of the above teachings and within the purview of the appended claims without departing from the spirit and intended scope of the present invention.

What is claimed is:

1. A hearing system, for imparting audio information to an individual by vibrating the tympanic membrane of the middle ear of the individual, that comprises:

signal producing means for producing signals containing audio information which comprises a transmitting coil mounted on the promontory centered medial to the umbo of the tympanic membrane; and a transducer means responsive to said signal to cause mechanical vibrations representing said audio information, wherein said transducer means is attached to the manubrium of the malleus.

2. The hearing system of claim 1 wherein said signal producing means comprises:

means for converting acoustic energy into electrical signals;

means for amplifying the electrical signals; and means for providing electrical energy to the converting and amplifying means, wherein the amplifying means is connected to said transmitting coil.

3. The hearing system of claim 1 wherein said transducer means comprises a magnet.

4. The hearing system of claim 1 wherein said signals containing audio information are electromagnetic signals.

5. The hearing system of claim 1 wherein said transducer further resides on an exterior surface of said tympanic membrane.

6. A method for imparting audio information to an individual by vibrating the tympanic membrane of individual, comprising the steps of:

providing a signal producing means for producing signals containing audio information which comprises a transmitting coil mounted on the promontory of the middle ear; and securing a transducer means responsive to said signal to cause mechanical vibrations representing said audio information to a surface of the manubrium of the malleus.

7. The method of claim 6 wherein said signal producing means comprises:

means for converting acoustic energy into electrical signals;

means for amplifying the electrical signals; and means for providing electrical energy to the converting and amplifying means, wherein the amplifying means is connected to said transmitting coil.

8. The method of claim 6 wherein said transducer means comprises a magnet.

9. The method of claim 6 wherein said signals containing audio information are electromagnetic signals.

10. The method of claim 6 wherein said transducer further resides on an exterior surface of said tympanic membrane.

11. A hearing system for imparting audio information to an individual that comprises:

a first device for converting acoustic energy into first electrical signals, comprising a magnet that is attached to the manubrium of the malleus of the individual's first ear and a coil mounted on the promontory centered medial to the umbo of the middle ear of said first ear, said coil responsive to movement of the magnet to create a first current in said coil; and a second device for converting said first current into mechanical vibrations that correspond to said audio information wherein said second device is positioned in the first ear or in the individual's second ear.

12. The hearing system of claim 11 wherein the second device comprises:

a transmitting coil mounted on the promontory centered medial to the umbo of the middle ear of the first or second ear; and a transducer means responsive to electromagnetic fields to cause mechanical vibrations representing said audio information, wherein said transducer means is attached to the manubrium of the malleus of the first or second ear.

13. The hearing system of claim 11 wherein said second device comprises a battery and an amplifier.

14. The hearing system of claim 12 wherein said transducer means comprises a second magnet.

15. The hearing system of claim 12 wherein said signals containing audio information are electromagnetic signals.

16. The hearing system of claim 12 wherein said transmitting coil is mounted on the promontory centered medial to the umbo of the first or second ear.

17. The hearing system of claim 12 wherein said transducer further resides on an exterior surface of said tympanic membrane of the first or second ear.

18. A method of imparting audio information to an individual that comprises the steps of:

providing a first device for converting acoustic energy into first electrical signals, comprising a magnet that is attached to the manubrium of the malleus of the individual's first ear and a coil mounted on the promontory centered medial to the umbo of the middle ear of said first ear, said coil responsive to movement of the magnet to create a first current in said coil; and providing a second device for converting said first current into mechanical vibrations that correspond to audio information wherein the second device is positioned in the first ear or in the individual's second ear.

19. The method of claim 18 wherein the second device comprises:

a transmitting coil mounted on the promontory centered medial to the umbo of the middle ear of the second ear; and a transducer means responsive to electromagnetic fields to cause mechanical vibrations representing said audio information, wherein said transducer means is attached to the manubrium of the malleus of the first or second ear.

20. The method of claim 18 wherein said second device comprises a battery and an amplifier.

21. The method of claim 19 wherein said transducer means comprises a second magnet.

22. The method of claim 19 wherein said signals containing audio information are electromagnetic signals.

23. The method of claim 19 wherein said transmitting coil is mounted on the promontory centered medial to the umbo of the first or second ear.

24. The method of claim 19 wherein said transducer further resides on the exterior surface of said tympanic membrane of the first or second ear.

25. The method of claim 20 wherein said battery and amplifier are mounted on a mastoid bone of the individual.

26. The method of claim 18 wherein said first device and second device are connected by a wire positioned subcutaneously in the skull of the individual.

* * * * *